US009689600B2

(12) United States Patent
Jeong et al.

(10) Patent No.: US 9,689,600 B2
(45) Date of Patent: Jun. 27, 2017

(54) ICEMAKER UNIT AND REFRIGERATOR HAVING THE SAME

(75) Inventors: Jin Jeong, Yongin-si (KR); Young Shik Shin, Seongnam-si (KR); Sang Hyun Park, Seongnam-si (KR); Quasim Khan, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 832 days.

(21) Appl. No.: 12/801,898

(22) Filed: Jun. 30, 2010

(65) Prior Publication Data

US 2011/0000248 A1 Jan. 6, 2011

(30) Foreign Application Priority Data

Jul. 6, 2009 (KR) ..... 10-2009-0061028

(51) Int. Cl.

| | |
|---|---|
| ***F25C 5/18*** | (2006.01) |
| ***F25C 1/00*** | (2006.01) |
| ***F25C 5/08*** | (2006.01) |
| ***F25C 1/04*** | (2006.01) |
| ***F25C 1/22*** | (2006.01) |
| ***F25C 1/24*** | (2006.01) |
| ***F25D 21/04*** | (2006.01) |
| ***F25D 21/14*** | (2006.01) |

(52) U.S. Cl.

CPC ..... *F25C 1/04* (2013.01); *F25C 1/22* (2013.01); *F25C 1/24* (2013.01); *F25C 5/08* (2013.01); *F25C 5/187* (2013.01); *F25D 21/04* (2013.01); *F25D 21/14* (2013.01); *F25C 2400/10* (2013.01); *F25C 2500/06* (2013.01); *F25D 2323/021* (2013.01)

(58) Field of Classification Search

CPC .... F25C 1/22; F25C 1/24; F25C 1/243; F25C 1/246; F25C 2300/00; F25C 2500/06

USPC ..... 62/340, 344, 349, 351, 341, 342, 343, 62/345, 356, 347, 348, 350, 352, 353, 62/354

See application file for complete search history.

(56) References Cited

U.S. PATENT DOCUMENTS 2,717,498 A * 9/1955 Shagaloff ..... F25C 1/04 249/70
2,717,500 A * 9/1955 Ploeger ..... 62/137
2,763,993 A * 9/1956 Bayston ..... 62/138

(Continued)

FOREIGN PATENT DOCUMENTS

JP 2-64375 * 3/1990 ..... F25C 1/18
JP 2006-234354 9/2006

(Continued)

OTHER PUBLICATIONS

Korean Office Action issued Sep. 22, 2015 in corresponding Korean Patent Application No. 10-2009-0061028.

(Continued)

*Primary Examiner* — Christopher R Zerphey
(74) *Attorney, Agent, or Firm* — Staas & Halsey LLP

(57) ABSTRACT

An icemaker unit and a refrigerator having the same. A drainage duct is provided to the icemaker unit, including a longitudinally inclined structure, a laterally inclined structure, and drainage holes to enhance drainage of the water. An upper part of the drainage duct is formed of a high heat-conductivity material and a lower part of the drainage duct of a low heat-conductivity material.

5 Claims, 12 Drawing Sheets

(56) References Cited

U.S. PATENT DOCUMENTS

| | | | | |
|---|---|---|---|---|
| 2,844,008 | A * | 7/1958 | Barton | 62/135 |
| 3,144,078 | A * | 8/1964 | Morton et al. | 165/263 |
| 6,438,988 | B1 * | 8/2002 | Paskey | 62/353 |
| 2006/0010900 | A1 * | 1/2006 | An et al. | 62/340 |
| 2006/0086135 | A1 * | 4/2006 | Wu et al. | 62/351 |
| 2007/0012061 | A1 * | 1/2007 | Ribeiro et al. | 62/344 |
| 2007/0261427 | A1 * | 11/2007 | Kim et al. | 62/351 |
| 2008/0209937 | A1 * | 9/2008 | Wu et al. | 62/340 |
| 2009/0165491 | A1 * | 7/2009 | Rafalovich et al. | 62/344 |

FOREIGN PATENT DOCUMENTS

| | | |
|---|---|---|
| KR | 20-0198195 | 7/2000 |
| KR | 10-2008-0014598 | 2/2008 |
| KR | 10-2008-0061180 | 7/2008 |
| KR | 10-2008-0106688 | 12/2008 |

OTHER PUBLICATIONS

Korean Office Action issued Mar. 19, 2015 in corresponding Korean Patent Application No. 10-2009-0061028.

* cited by examiner

ICEMAKER UNIT AND REFRIGERATOR HAVING THE SAME

CROSS-REFERENCE TO RELATED APPLICATIONS

This application claims the benefit of Korean Patent Application No. 2009-0061028, filed on Jul. 6, 2009 in the Korean Intellectual Property Office, the disclosure of which is incorporated herein by reference.

BACKGROUND

1. Field

Embodiments relate to a direct-cooling type icemaker unit of a refrigerator, capable of efficiently draining water melted from frost formed around an icemaker tray and a refrigerant pipe, and a refrigerator having the same.

2. Description of the Related Art

In general, a refrigerator includes a refrigerating chamber and a freezing chamber partitioned from each other and adapted to preserve various foods in an optimal state for a long time. Foods such as vegetables and fruits are stored above the freezing point, that is, in the refrigerating chamber. Foods such as meats and fish are stored below the freezing point, that is, in the freezing chamber.

Additionally, an icemaker unit that makes ice by freezing water may be equipped in the refrigerator. The icemaker unit includes a tray that receives water and makes ice therein, and an ice container that stores the made ice.

The icemaker unit may be classified into a fan-cooling type wherein cold air is supplied to the icemaker unit and forcibly convected to cool an icemaker tray, thereby turning water in the icemaker tray into ice, and a direct-cooling type, wherein the icemaker tray or water is brought into direct contact with a refrigerant pipe, thereby making ice.

The direct-cooling type has a simpler mechanism than the fan-cooling type and achieves the ice making at a very high speed.

However, according to the direct-cooling method, much frost is generated at the icemaker tray and around the refrigerant pipe. If the frost melts during separation of the ice made in the icemaker tray, the ice may form a lump. Accordingly, the reliability of the product and the total performance of the ice making may be deteriorated.

SUMMARY

Therefore, it is an aspect to provide an icemaker unit of a refrigerator, capable of efficiently draining water melted from frost formed around an icemaker tray and a refrigerant pipe, and a refrigerator having the same.

It is another aspect to provide an icemaker unit improving the efficiency of circulating the cold in an ice making chamber equipped with the icemaker unit.

Additional aspects will be set forth in part in the description which follows and, in part, will be apparent from the description, or may be learned by practice of the invention.

The foregoing and/or other aspects are achieved by providing an icemaker unit including an icemaker tray to receive water; a cold transmission device disposed at a lower part of the icemaker tray to transmit cold directly to the icemaker tray; and a drainage duct disposed at a lower part of the cold transmission device.

The drainage duct may have an inclined structure. The inclined structure may include at least one of a longitudinal inclined structure formed in a length direction of the icemaker tray and a lateral inclined structure formed in a width direction of the icemaker tray. The drainage duct may include a drainage hole formed at an end of the inclined structure. The drainage hole may be connected to a drainage hose to drain water. The icemaker unit may further include a fixer to fix the cold transmission device to the icemaker tray. One side of the fixer may be hinged upon a lower part of the icemaker tray while the other side is hooked with the lower part of the icemaker tray. The fixer may include a plurality of drainage holes to drain water. The fixer may include a plurality of fixing recesses to stably fix the cold transmission device to the icemaker tray. The fixer may be integrally formed with the drainage duct. The drainage duct may have a greater width than the icemaker tray.

The icemaker unit may further include an ice-full state sensing lever to detect an ice-full state of an ice container storing the ice discharged from the icemaker unit, and the ice-full state sensing lever may be disposed at a side of the icemaker tray.

The foregoing and/or other aspects are achieved by providing a refrigerator having an icemaker unit that makes ice, wherein the icemaker unit includes an icemaker tray to receive water; a refrigerant pipe in which refrigerant is circulated by a refrigerating cycle, thereby transmitting the cold directly to the icemaker tray; and a drainage duct to collect and drain water generated at the icemaker tray and around the refrigerant pipe, and wherein the drainage duct is removably connected to the icemaker tray.

The icemaker unit may further include a machine chamber disposed at one side of the icemaker unit to mount various electric parts therein. The icemaker tray may be disposed at a side of the machine chamber, an ice separation heater to heat the icemaker tray and the refrigerant pipe may be provided at a lower part of the icemaker tray. The ice separation heater and the refrigerant pipe may be arranged not to overlap each other and are in contact with the icemaker tray.

The refrigerator may further include a refrigerating chamber to store goods in a refrigerated state. The refrigerating chamber may include an ice making chamber therein in which ice is made and stored, and the icemaker may be disposed in the ice making chamber.

The foregoing and/or other aspects are achieved by providing an icemaker unit including an icemaker tray to receive water; a refrigerant pipe disposed at a lower part of the icemaker tray to transmit the cold directly to the icemaker tray; and a drainage duct disposed at a lower part of the refrigerant pipe to enhance drainage of water, wherein the drainage duct includes a first member made of a high heat-conductivity material and a second member made of a low heat-conductivity material.

An adiabatic material may be disposed between the first member and the second member. A drain heater may be provided between the first member and the adiabatic material so as to prevent formation of frost. The first member may include aluminum while the second member includes plastic formed by injection-molding.

The icemaker unit may further include an ice separation heater to heat the icemaker tray, and a fixer to fix the refrigerant pipe to the icemaker tray. The icemaker tray, the refrigerant pipe, the ice separation heater and the fixer may include aluminum.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
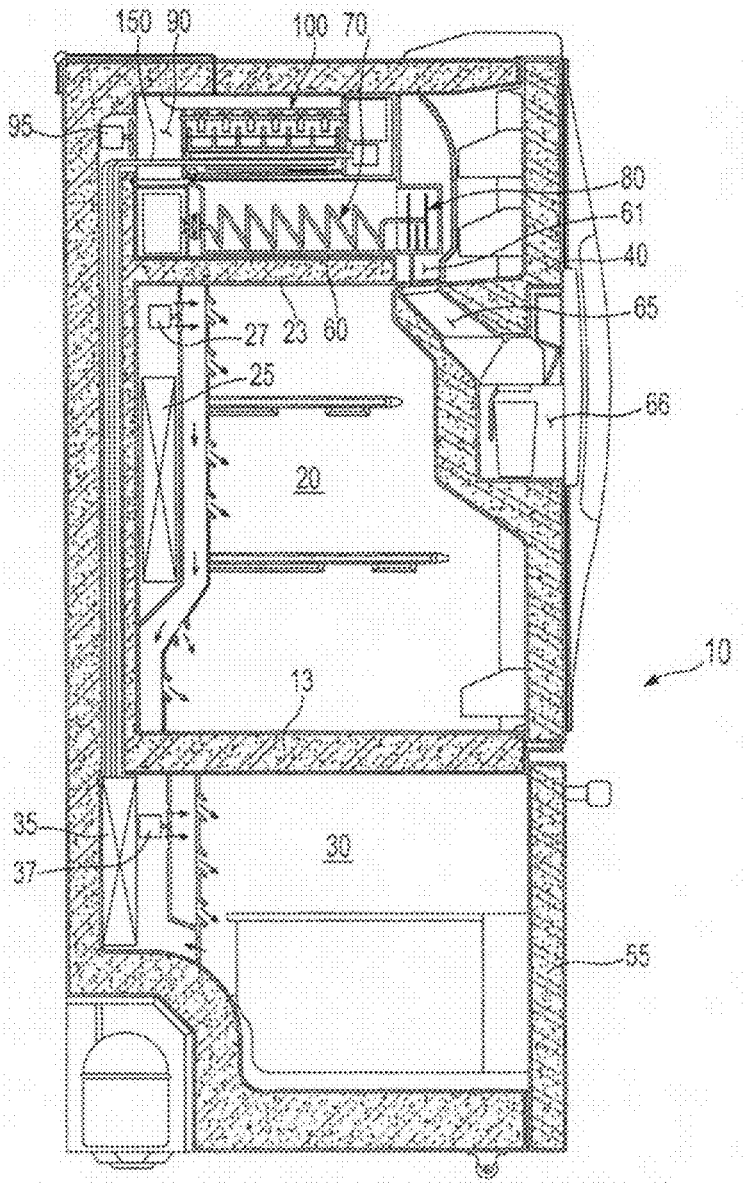
FIG. 1 is a sectional view of a refrigerator having an icemaker unit according to an embodiment.

Reference will now be made in detail to the embodiments, examples of which are illustrated in the accompanying drawings, wherein like reference numerals refer to like elements throughout.

Figure 2:
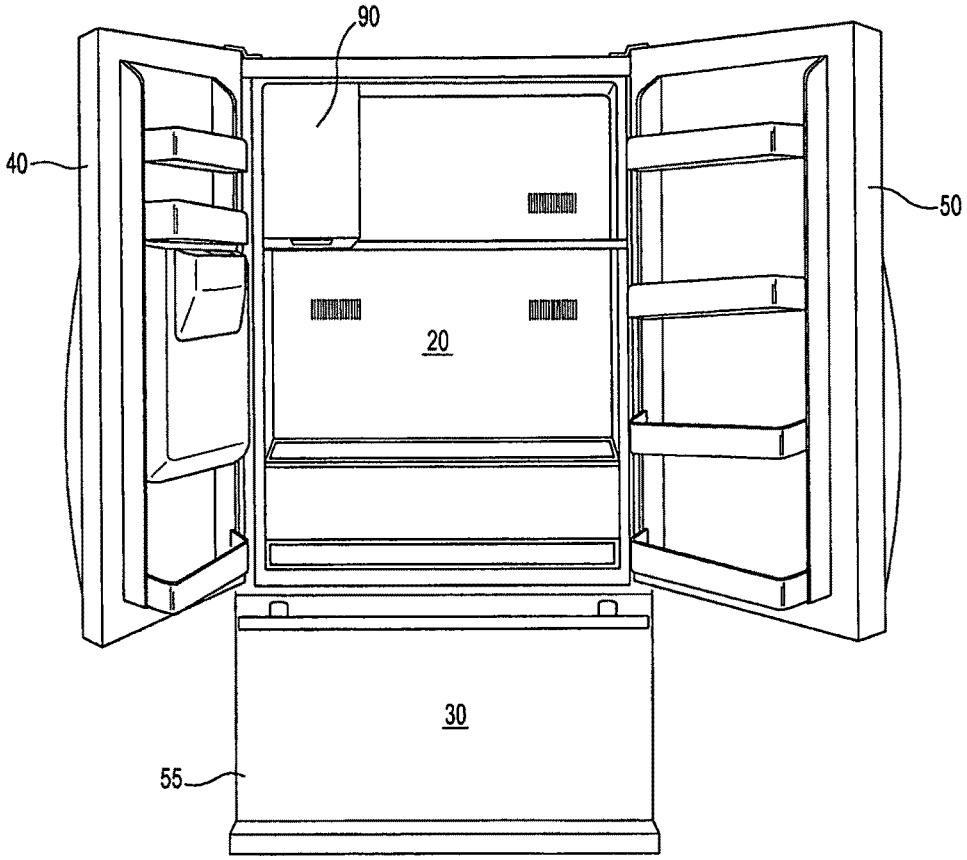
FIG. 2 is a front view of the refrigerator of FIG. 1.

FIG. 1 is a sectional view of a refrigerator having an icemaker unit according to an embodiment. FIG. 2 is a front view of the refrigerator having the icemaker unit.

Referring to FIG. 1 and FIG. 2, the refrigerator includes a main body 10 divided by a partition 13 into a refrigerating chamber 20 disposed at an upper part and a freezing chamber 30 disposed at a lower part.

The refrigerating chamber 20 and the freezing chamber 30 are opened to the front. As shown in FIG. 2, the refrigerating chamber 20 disposed at the upper part is opened and closed by a first refrigerating chamber door 40 and a second refrigerating chamber door 50, while the freezing chamber 30 is opened and closed by a freezing chamber door 55. The first and the second refrigerating chamber doors 40 and 50 are pivotably connected to both sides of the main body 10 to open and close the refrigerating chamber 20 in lateral directions. The freezing chamber door 55 may open and close the freezing chamber 30 by being drawn in and out.

At an inner rear part of the refrigerating chamber 20, a refrigerating chamber evaporator 25 and a refrigerating chamber circulation fan 27 are provided to cool the refrigerating chamber 20 and to circulate the cold in the refrigerating chamber 20, respectively.

Likewise, the freezing chamber 30 includes, at an inner rear part thereof, a freezing chamber evaporator 35 to cool the freezing chamber 30 and a freezing chamber circulation fan 37 to circulate the cold in the freezing chamber 30.

In addition, an ice making chamber 90 is formed at one upper corner of the refrigerating chamber 20, being partitioned from the inner space of the refrigerating chamber 20 by an adiabatic wall 23.

An ice making chamber ventilation fan 95 is mounted at a rear part of the ice making chamber 90 to circulate air in the ice making chamber 90. A refrigerant pipe 150 is branched from the freezing chamber evaporator 35 and extended into the ice making chamber 90. Refrigerant being circulated by a refrigerating cycle flows through the refrigerant pipe 150.

A water supply pipe 97 is mounted at an upper part of the ice making chamber 90 to supply water into the ice making chamber 90.

The ice making chamber 90 includes an icemaker unit 100 that makes ice, an ice container 60 that stores the ice made by the icemaker unit 100 and has an ice discharge port 61 at one side thereof, an ice transferring device 70 that discharges the ice, and an ice crushing device 80 that crushes the ice being discharged through the ice discharge port 61 as necessary.

The first refrigerating chamber door 40 includes a discharge chute 65 that guides the ice discharged from the ice container 60 through the ice discharge port 61, to the outside. In addition, an ice receiving space 66 is provided in the front side of the first refrigerating chamber door 40 to receive the ice being discharged through the discharge chute 65.

Hereinafter, the icemaker unit 100 according to the embodiment will be described in detail.

Figure 3:
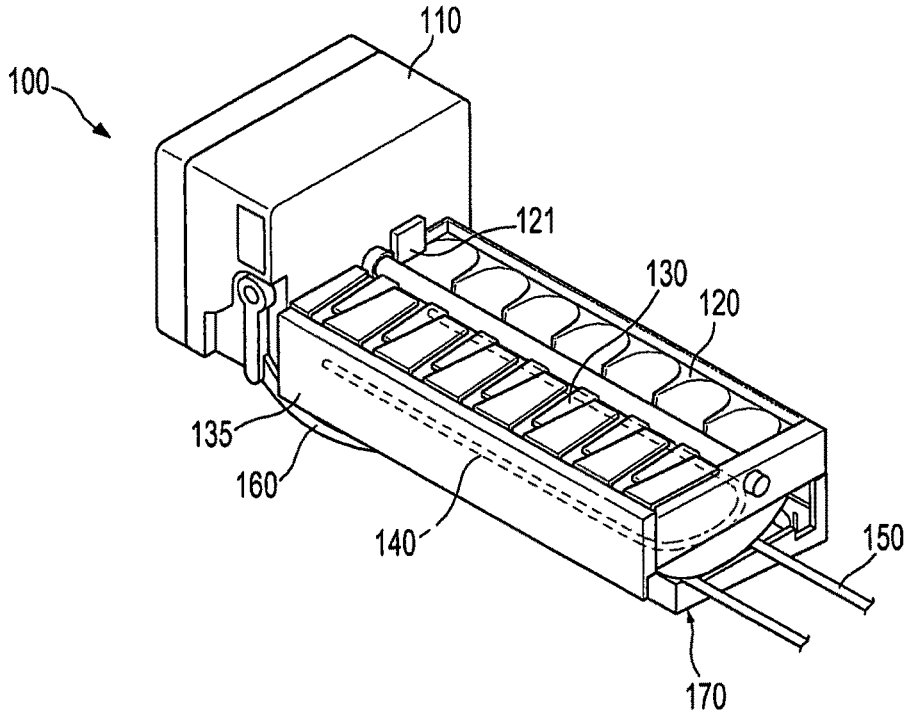
FIG. 3 is an assembled perspective view of the icemaker unit.
Figure 4:
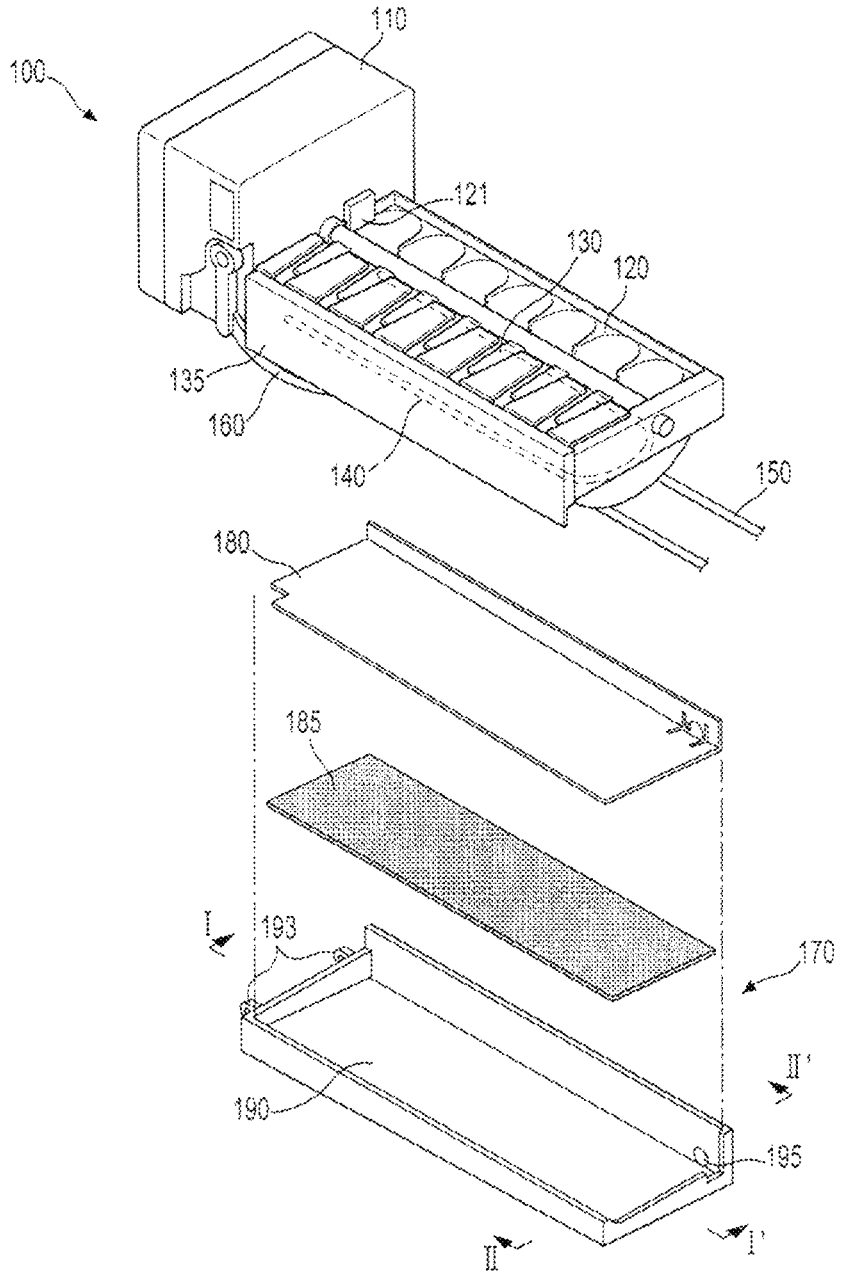
FIG. 4 is an exploded perspective view of an upper part of the icemaker unit.
Figure 5:
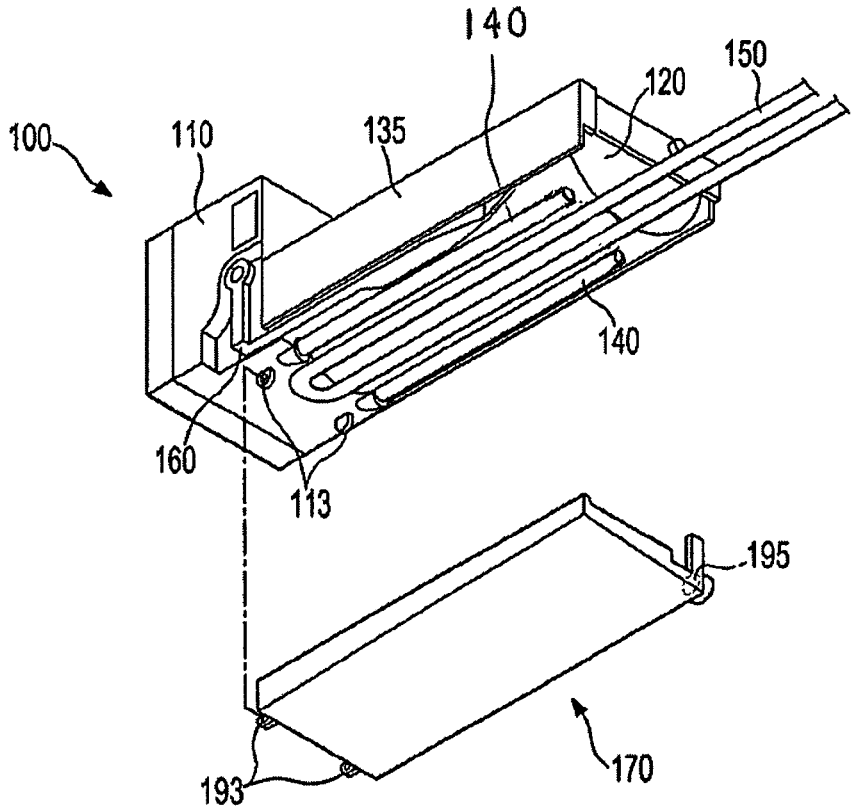
FIG. 5 is an exploded perspective view of a lower part of the icemaker unit.
Figure 6A:
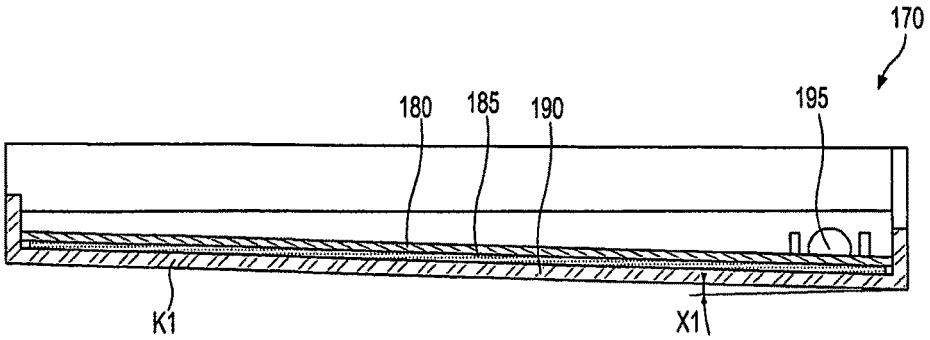
FIG. 6A is a sectional view of a drainage duct shown in FIG. 3, cut along a line I-I'.
Figure 6B:
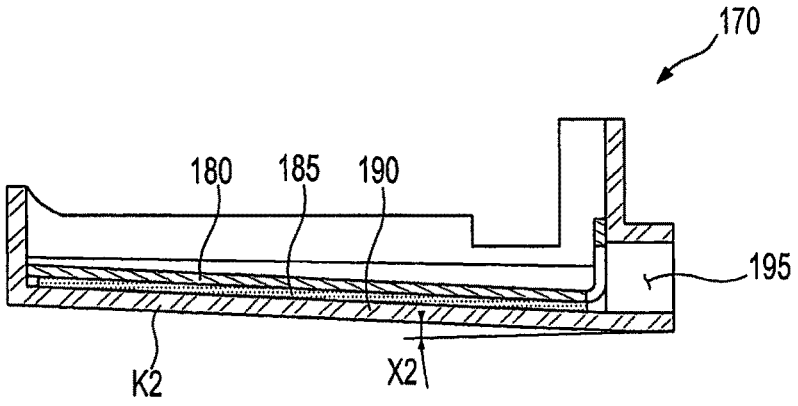
FIG. 6B is a sectional view of the drainage duct shown in FIG. 3, cut along a line II-II'.
Figure 7:
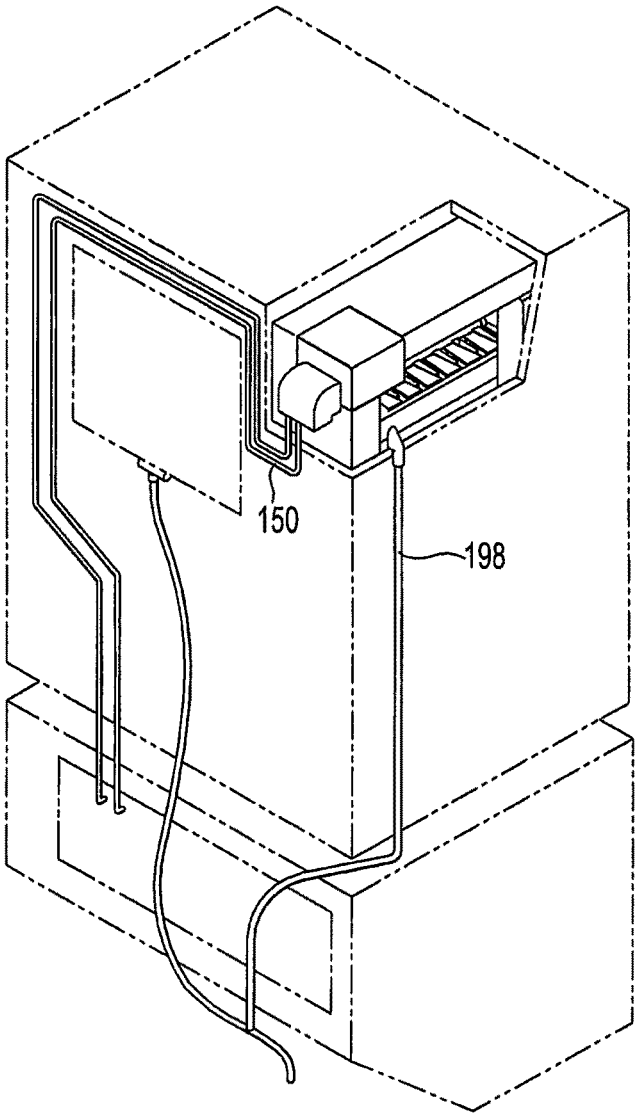
FIG. 7 is a schematic rear view of the refrigerator, showing the drainage structure of the drainage duct.

FIG. 3 is an assembled perspective view of the icemaker unit. FIG. 4 is an exploded perspective view of an upper part of the icemaker unit. FIG. 5 is an exploded perspective view of a lower part of the icemaker unit. FIG. 6A is a sectional view of a drainage duct shown in FIG. 3, cut along a line I-I' and FIG. 6B is a sectional view of the drainage duct shown in FIG. 3, cut along a line II-II'. FIG. 7 is a schematic rear view of the refrigerator, showing the drainage structure of the drainage duct.

As shown in FIG. 3 to FIG. 5, the icemaker unit 100 includes a machine chamber 110 in which various electric parts are installed, an icemaker tray 120 disposed at one side of the machine chamber 110, an ice separation heater 140 disposed at a lower part of the icemaker tray 120 to heat the icemaker tray 120, the refrigerant pipe 150 disposed at the lower part of the icemaker tray 120 not to overlap the ice separation heater 140, and a drainage duct 170 disposed at a lower part of the icemaker tray 120 and the refrigerant pipe 150.

The machine chamber 110 is connected to a ceiling of the ice making chamber 90, thereby fixing and supporting the entire icemaker unit 100. Various electric parts required for the icemaker unit 100 are arranged in the machine chamber 110.

The icemaker tray 120 receives water supplied through the water supply pipe 97 and makes ice therein.

An ice separation member 130 to separate the ice is mounted at an upper part of the icemaker tray 120. The ice separation member 130 is rotatably connected to the machine chamber 110 and is rotated by a motor built in the machine chamber 110, thereby separating the ice from the icemaker tray 120.

An ice separation member guide 135 is provided at one side of the ice separation member 130, to prevent overflow of the water in the icemaker tray 120 while assisting the rotation of the ice separation member 130.

An ice-full state sensing lever 160 is provided between the icemaker tray 120 and the ice separation member guide 135, so as to detect an ice-full state of the ice container 60.

The icemaker tray 120 includes a temperature sensor 121 disposed at one side thereof to measure the inner temperature thereof.

An ice separation heater 140 and the refrigerant pipe 150 are disposed at the lower part of the icemaker tray 120, so as not to overlap each other while directly contacting the icemaker tray 120.

The ice separation heater 140 heats the icemaker tray 120 using power supplied from the machine chamber 110, thereby facilitating separation of the ice made in the icemaker tray 120.

The refrigerant pipe 150 is in direct contact with the lower part of the icemaker tray 120 and thereby transmits the cold to the icemaker tray 120. That is, the icemaker unit 100 according to this embodiment has the direct-cooling system that makes ice by directly transmitting the cold.

In addition, the drainage duct 170 is disposed at the lower part of the icemaker tray 120 and the refrigerant pipe 150, to collect and drain water generated around the icemaker tray 120 and the refrigerant pipe 150.

The drainage duct 170 is connected to the icemaker unit 100 by connecting a mounting part 193 formed at one side thereof with a connection part 113 formed on a lower part of the machine chamber 110. In other words, the drainage duct 170 may be freely separated and mounted.

The drainage duct 170 includes a first member 180 made of a high heat-conductivity material, a second member 190 disposed at a lower part of the first member 180 and made of a low heat-conductivity material, and an adiabatic material 185 disposed between the first and the second members 180 and 190. That is, the first member 180, the adiabatic material 185 and the second member 190 are accumulated in that sequence.

Water melted from frost generated at the icemaker tray 120 and the refrigerant pipe 150 falls directly to the first member 180. Therefore, as the heat conductivity of the first member 180 is high, the water may be more efficiently drained through the drainage hole 195.

Aluminum is typically used as the material of the first member 180. However, any other material having high heat conductivity is applicable.

The second member 190 is adjacent to the refrigerant pipe 150 disposed at the upper part thereof, and therefore is subject to the cold and likely to generate frost at the lower part of the drainage duct 170. To this end, exemplarily, the second member 190 is made of a low heat-conductivity material to reduce formation of the frost.

The second member 190 generally takes the form of injection molded plastic. However, any other material having low heat conductivity may be used.

The adiabatic material 185 interrupts heat transmission between the first member 180 and the second member 190.

The drainage duct 170 has a greater width than the icemaker tray 120, so as to effectively collect and drain most of the water formed around the icemaker tray 120 and the refrigerant pipe 150.

The drainage duct 170 may have an inclined structure K1 or K2 as shown in FIGS. 6A and 6B.

The inclined structures K1 and K2 include a longitudinally inclined structure K1 formed in a length direction of the icemaker tray 120, and a laterally inclined structure formed in a width direction of the icemaker tray 120.

The longitudinally inclined structure K1 is inclined by a predetermined angle X1 with respect to a horizontal surface. The laterally inclined structure K2 is inclined by another predetermined angle X2 with respect to a horizontal surface. A drainage hole 195 is formed at an end of the longitudinally inclined structure K1 and the laterally inclined structure K2 to drain water therethrough.

The inclined structures K1 and K2 are designed so that the water that has fallen into the drainage duct 170 efficiently flows to the drainage hole 195.

As shown in FIG. 7, the drainage hole 195 is connected to a drainage hose 198 mounted at the outside of the ice making chamber 90. The drainage hose 198 is extended up to an evaporating dish (not shown) installed at a refrigerator machine chamber formed at a lower part of the refrigerator. That is, the water drained through the drainage hole 195 arrives at the evaporating dish (not shown) in the refrigerator machine chamber and evaporates.

Hereinafter, the operations of the icemaker unit 100 according to the embodiment and a refrigerator having the same will be described.

When a user connects the refrigerator to a power source and operates the icemaker unit 100, water is supplied through the water supply pipe 97 and received in the icemaker tray 120.

The refrigerant flows through the refrigerant pipe 150, transmitting the cold to the icemaker tray 120. Accordingly, ice is made in the icemaker tray 120.

Here, while the ice is being formed in the icemaker tray 120, frost is also formed around the refrigerant pipe 150 and the icemaker tray 120 which is adjacent to the refrigerant pipe 150.

Next, the ice separation heater 140 and the ice separation member 130 are operated so as to separate the ice in the icemaker tray 120 into the ice container 60.

When the ice separation heater 140 heats the icemaker tray 120, not only the ice but also the frost formed around the icemaker tray 120 and the refrigerant pipe 150 melt and flow downward.

The water falls to the drainage duct 170 and flows along the inclined structure K1 or K2 of the drainage duct 170, finally arriving at the drainage hole 195. The water continues flowing through the drainage hose 198 mounted at the outside of the ice making chamber 90 up to the evaporating dish in the refrigerator machine room. The water in the evaporating dish naturally evaporates.

If the water melted from the frost falls directly to the ice container 60, the ice in the ice container 60 may clump together. If the water falls to the ice-full state sensing lever 160, malfunction of the ice-full state sensing lever 160 may result. In this regard, the drainage duct 170 may prevent such undesired cases, thereby improving product reliability.

Meanwhile, the air in the ice making chamber 90 may be circulated by the ice making chamber ventilation fan 95. In this case, the air being circulated is passed through a space between the icemaker tray 120 and the drainage duct 170. Therefore, the cold of the refrigerant pipe 150 is evenly spread throughout the ice making chamber 90. That is, the drainage duct 170 may enhance the efficiency of the air circulation in the ice making chamber 90. As a result, the ice making chamber 90 may be maintained at a constant low temperature.

Hereinafter, an icemaker unit 200 according to another embodiment will be described. The same elements and functions as described above will not be explained again.

Figure 8:
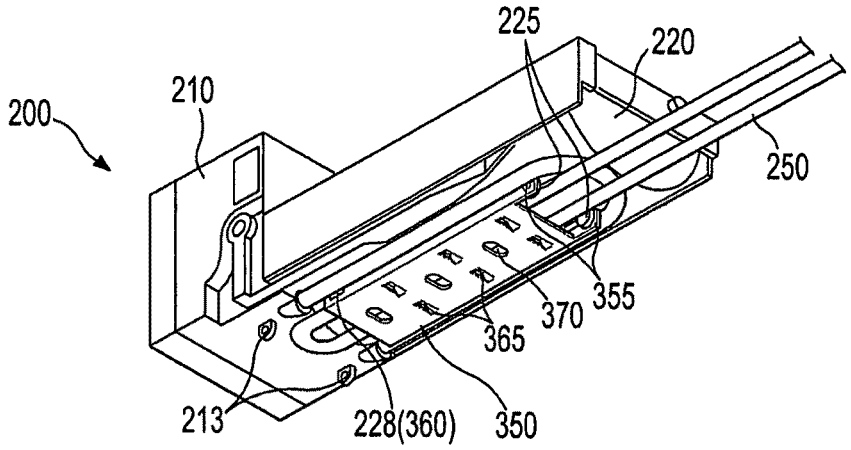
FIG. 8 is an assembled perspective view of an icemaker unit according to another embodiment.
Figure 9:
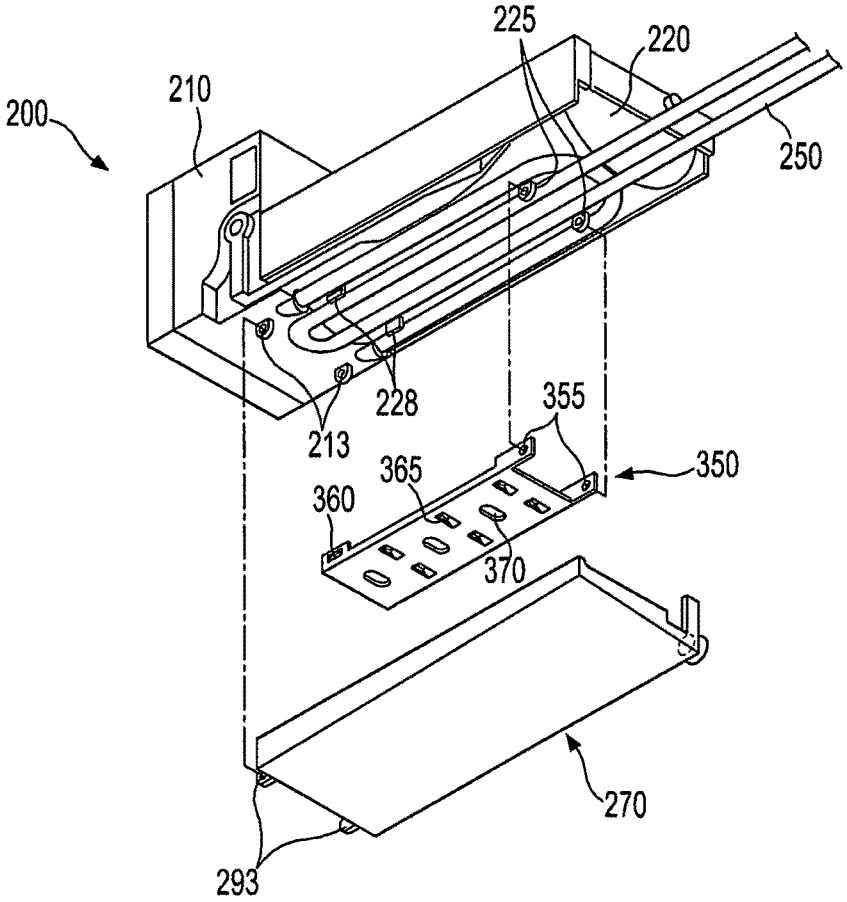
FIG. 9 is an exploded perspective view of an icemaker unit according to the embodiment of FIG. 8.

FIG. 8 is an assembled perspective view of an icemaker unit according to another embodiment, and FIG. 9 is an exploded perspective view of an icemaker unit according to the embodiment of FIG. 8.

Referring to FIG. 8 and FIG. 9, the icemaker unit 200 further includes a machine chamber 210, a fixer 350 disposed among an icemaker tray 220, a refrigerant pipe 250, mounting portions 213 and 293 and a drainage duct 270.

One side of the fixer 350 is hinged upon the icemaker tray 220, while the other side is hooked with the icemaker tray 220. The hinge connection is achieved as a hinge member 355 of the fixer 350 is engaged with a hinge connection part 225 of the icemaker tray 220. The hook connection is achieved as a hook member 360 of the fixer 350 is inserted in a hook connection part 228 of the icemaker tray 220.

The fixer 350 includes a plurality of fixing projections 365 to stably fix the refrigerant pipe 250 to the icemaker tray 220. The fixing projections 365 keep the refrigerant pipe 250 in close contact with the icemaker tray 220 and also prevent movement of the refrigerant pipe 250.

The fixer 350 further includes a plurality of drainage holes 370 to drain water. The drainage holes 370 help the water generated at the icemaker tray 220 and around the refrigerant pipe 250 to smoothly flow toward the drainage duct 270.

The other structures of the icemaker unit 200 are the same as in the previous embodiment.

Hereinafter, an icemaker unit 500 according to still another embodiment will be described. The same elements and functions as described above will not be explained again.

Figure 10:
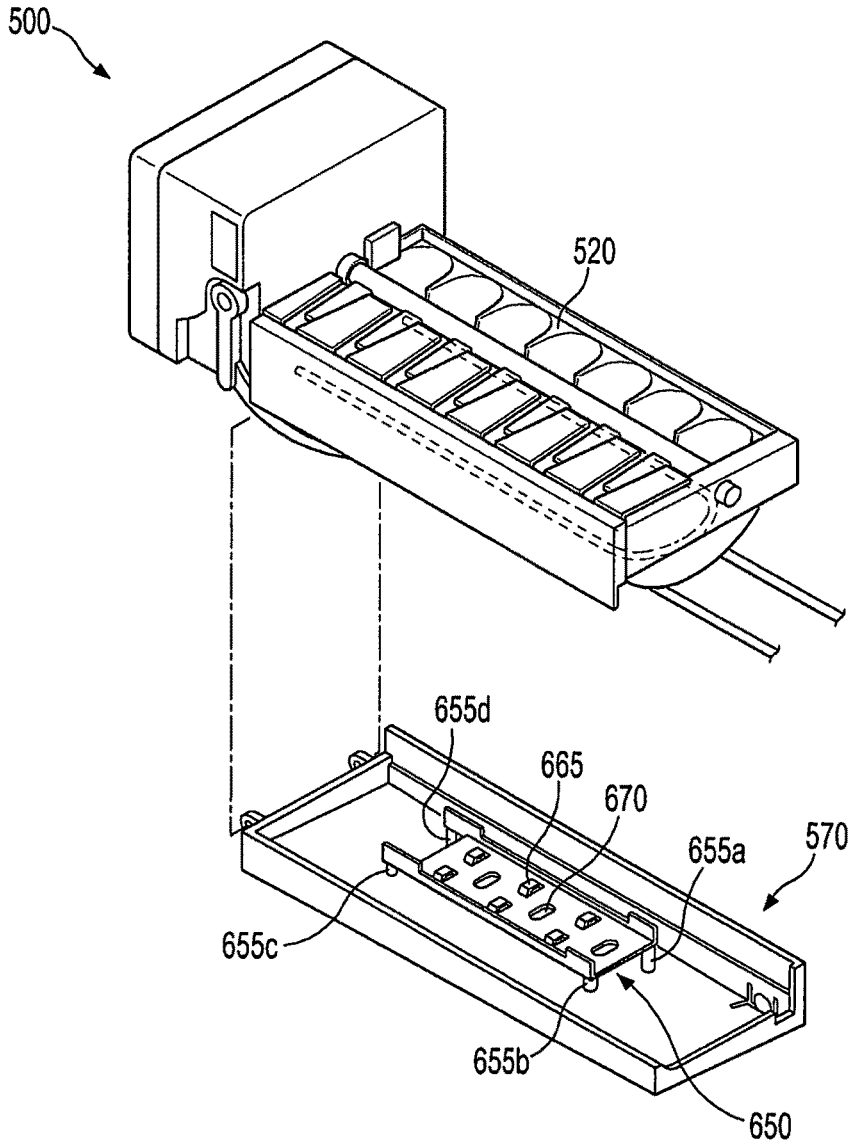
FIG. 10 is an exploded perspective view of an icemaker unit according to still another embodiment.

FIG. 10 is an assembled perspective view of the icemaker unit according to still another embodiment.

Referring to FIG. 10, the icemaker unit 500 includes a fixer 650 integrally formed with a drainage duct 570.

The fixer 650 is connected to an upper surface of the drainage duct 570 through connection bars 655*a*, 655*b*, 655*c* and 655*d*. By thus structuring the fixer 650 and the drainage duct 570 into an integral body, the assembly process may be simplified. Specifically, assembly of the icemaker unit 500 may be completed simply by connecting the drainage duct 570, without having to fix the fixer 650 to the icemaker tray 520 and then connect the drainage duct 570.

The fixer 650 has fixing projections 665 and drainage holes 670 in the same manner as in the embodiment of FIGS. 8 and 9.

Also, the other structures of this embodiment are the same as in the previous embodiments.

Hereinafter, an icemaker unit 700 according to a further embodiment will be described, omitting the description about the same elements and structures as in the previous embodiments.

Figure 11:
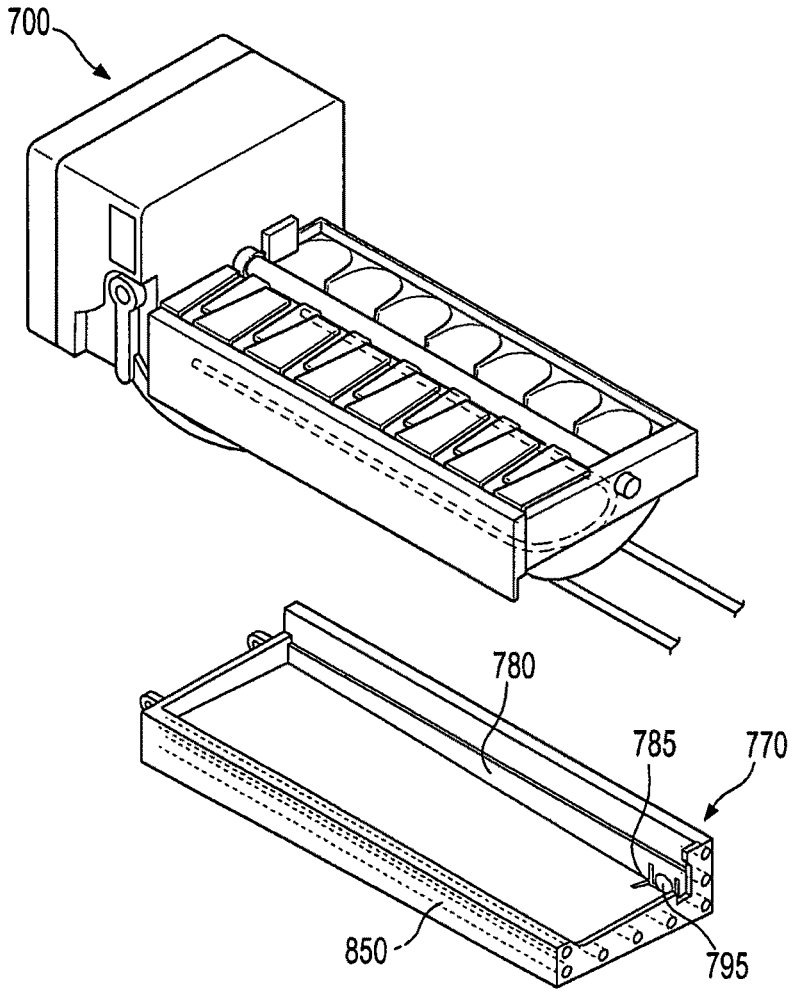
FIG. 11 is an exploded perspective view of an icemaker unit according to a further embodiment.

FIG. 11 is an exploded perspective view of an icemaker unit according to a further embodiment.

As shown in FIG. 11, a drainage duct 770 includes a drain heater 850 mounted in a length direction of the drainage duct 770 between a first member 780 and an adiabatic material 785.

The drain heater 850 may minimize formation of frost at a lower part of the drainage duct 770 and, furthermore, helps the water that has fallen into an upper surface of the drainage duct 770 to quickly flow to a drainage hole 795 without freezing.

The other structures of the icemaker unit 700 of FIG. 11 are the same as in the previous embodiments.

As is apparent from the above description, in accordance with an icemaker unit and a refrigerator having the same according to the embodiments, a drainage duct is provided at a lower part of an icemaker tray so as to collect and drain water formed at the icemaker tray and the refrigerant pipe.

In addition, since the drainage duct may also serve as an air circulation path, the cold of the refrigerant pipe is transmitted into the ice making chamber, thereby constantly maintaining a low inner temperature of the ice making chamber.

Although a few embodiments have been shown and described, it would be appreciated by those skilled in the art that changes may be made in these embodiments without departing from the principles and spirit of the embodiments, the scope of which is defined in the claims and their equivalents.

What is claimed is:

1. An icemaker unit comprising:

an independent heat insulated ice making chamber that is separated from a storage compartment of a refrigerator, the ice making chamber containing:

an icemaker tray to receive water;

a cold transmission device disposed at a lower part of the icemaker tray to transmit cold directly to the icemaker tray;

a drainage duct disposed at a lower part of the cold transmission device, the drainage duct being configured to drain water to the outside of the ice making chamber and to serve as an air circulation path;

a fixer to fix the cold transmission device to the icemaker tray; and an ice separation heater to heat the icemaker tray, wherein the fixer directly contacts the cold transmission device when connected to the ice maker tray and is located between the icemaker tray and the drainage duct, wherein the drainage duct comprises a base continually sloped towards a drainage hole, wherein the fixer comprises a plate with a plurality of fixing projections aligned with and in contact with only a lower surface of the cold transmission device and a plurality of drainage holes to drain water away from the icemaker tray and the cold transmission device to the drainage duct, whereby the fixer is configured to stably fix the cold transmission device to the icemaker tray while allowing air circulating in the drainage duct to contact the cold transmission device, wherein the fixer is connected to and spaced apart from the drainage duct by a plurality of connection bars, and wherein the ice separation heater and the cold transmission device are arranged not to overlap each other along the length of the fixer and are in contact with the icemaker tray.

2. The icemaker unit according to claim 1, further comprising a drainage hose, wherein the drainage hole is connected to the drainage hose to drain water.

3. The icemaker unit according to claim 1, wherein the fixer is integrally formed with the drainage duct.

4. The icemaker unit according to claim 1, wherein the drainage duct has a greater width than the icemaker tray.

5. The icemaker unit according to claim 1, further comprising an ice-full state sensing lever to detect an ice-full state of an ice container storing the ice discharged from the icemaker unit, wherein the ice-full state sensing lever is disposed at a side of the icemaker tray.

* * * * *